US008819967B2

(12) United States Patent
Campomanes

(10) Patent No.: US 8,819,967 B2
(45) Date of Patent: Sep. 2, 2014

(54) ADAPTER STABILIZATION STRUCTURE FOR BUCKET LIP

(71) Applicant: Hensley Industries, Inc., Dallas, TX (US)

(72) Inventor: Patrick Campomanes, Washington, IL (US)

(73) Assignee: Hensley Industries, Inc., Dallas, TX (US)

( * ) Notice: Subject to any disclaimer, the term of this patent is extended or adjusted under 35 U.S.C. 154(b) by 0 days.

(21) Appl. No.: 13/761,273

(22) Filed: Feb. 7, 2013

(65) Prior Publication Data

US 2013/0247427 A1 Sep. 26, 2013

Related U.S. Application Data

(60) Provisional application No. 61/613,719, filed on Mar. 21, 2012.

(51) Int. Cl.
*E02F 9/28* (2006.01)

(52) U.S. Cl.
CPC ..... *E02F 9/2883* (2013.01); *E02F 9/2825* (2013.10)
USPC ..... 37/450; 37/453; 37/455

(58) Field of Classification Search
USPC ..... 37/450, 453, 454, 455
See application file for complete search history.

(56) References Cited

U.S. PATENT DOCUMENTS

| | | | | |
|---|---|---|---|---|
| 2,189,745 | A | 2/1940 | Johnson | |
| 2,238,081 | A * | 4/1941 | Soberanes | 37/455 |
| 3,496,658 | A * | 2/1970 | Eyolfson | 37/455 |
| 3,839,805 | A * | 10/1974 | Stepe | 37/454 |
| 4,414,764 | A | 11/1983 | Johansson et al. | |
| 5,056,243 | A | 10/1991 | Sprunger et al. | |
| 5,144,762 | A | 9/1992 | Robinson | |
| 5,564,206 | A * | 10/1996 | Ruvang | 37/458 |
| 5,718,070 | A * | 2/1998 | Ruvang | 37/459 |
| 6,209,238 | B1 | 4/2001 | Ruvang | |
| 6,393,739 | B1 * | 5/2002 | Shamblin et al. | 37/456 |

(Continued)

FOREIGN PATENT DOCUMENTS

EP 0203315 12/1986

OTHER PUBLICATIONS

International Search Report and Written Opinion issued for PCT/US2013/030334 dated May 20, 2013, 12 pgs.

*Primary Examiner* — Gary Hartmann
(74) *Attorney, Agent, or Firm* — Haynes & Boone, LLP

(57) ABSTRACT

A ground engaging support structure such as an adapter is mounted on the front edge of an excavating bucket lip in a manner inhibiting side-to-side movement of the installed adapter, and shielding the front bucket lip edge from operational wear at the adapter installation location using opposing tapered block members secured to the front lip edge for movement toward a forwardly projecting stabilizing portion of the lip edge. As the adapter is telescoped onto the front lip edge over its stabilizing projection, correspondingly tapered portions of the adapter engage the block members and move them toward one another and toward the stabilizing projection. Rear leg portions of the adapter are then suitably secured to the bucket lip. The repositioned block members interposed between the adapter the front bucket lip edge then inhibit side-to-side shifting of the installed adapter while also shielding the lip edge from operational abrasion wear.

25 Claims, 2 Drawing Sheets

(56) References Cited

U.S. PATENT DOCUMENTS

| | | | | |
|---|---|---|---|---|
| 6,986,216 | B2 | 1/2006 | Emrich et al. | |
| 7,472,503 | B2 | 1/2009 | Maher | |
| 7,690,136 | B2 | 4/2010 | Breken | |
| 7,690,137 | B2 * | 4/2010 | Pasqualini | 37/455 |
| 7,882,649 | B2 | 2/2011 | Carpenter et al. | |
| 7,980,011 | B2 | 7/2011 | Ruvang | |
| 2003/0037468 | A1 | 2/2003 | Adamic et al. | |
| 2010/0236108 | A1 | 9/2010 | Ruvang | |

* cited by examiner

ADAPTER STABILIZATION STRUCTURE FOR BUCKET LIP

CROSS-REFERENCE TO RELATED APPLICATION

The present application claims the benefit of the filing date of provisional U.S. patent application No. 61/613,719 filed Mar. 21, 2012. The entire disclosure of the provisional application is hereby incorporated herein by this reference.

BACKGROUND OF THE INVENTION

The present invention relates generally to ground engaging apparatus and, in a representative embodiment thereof, more particularly provides specially designed apparatus for (1) inhibiting undesirable side-to-side movement of a wear member support structure, such as an adapter, relative to a front bucket lip edge on which the adapter is mounted, and (2) shielding the bucket lip edge from operational wear at the wear member mounting location thereon.

In ground engaging arts such as excavation and mining it is common practice to secure a support structure, such as an adapter to which a wear member (such as a replaceable tooth point) may in turn be mounted, to a front edge portion of an excavating bucket lip. Typically, the adapter has rear top and bottom leg portions which straddle the front bucket lip edge and are secured to the bucket lip rearwardly of its front edge to hold the installed adapter in place on the bucket lip. It is considered desirable to inhibit side-to-side movement of the installed adapter relative to the bucket lip, and to additionally shield the front bucket lip edge from operational wear at the adapter installation location thereon.

Previous attempts to meet these two design criteria have often proven to be less than entirely satisfactory due to undesirably high expense and/or complexity. It would accordingly be desirable to provide improved apparatus for stabilizing a lip-mounted ground engaging support structure that was substantially less costly and complex. It is to this goal that the present invention is primarily directed.

DETAILED DESCRIPTION

Figure 1:
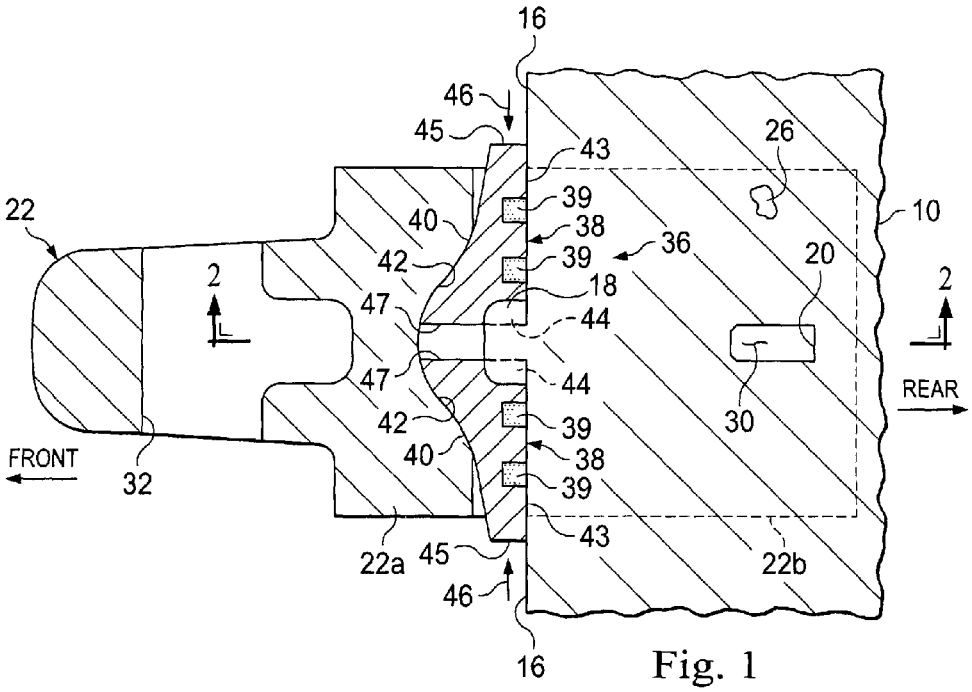
FIG. 1 is a downwardly directed partial cross-sectional view through a front edge portion of an excavating bucket lip to which an adapter is removably attached, with the attached adapter being restrained against undesirable side-to-side movement by a specially designed adapter stabilization system embodying principles of the present invention.

Turning now to the drawings, a bottom metal excavating bucket lip 10 has top and bottom sides 12 and 14, a front edge 16, and a series of forwardly extending stabilizing projections 18 (only one of which is visible) spaced apart along the length of the front lip edge 16. Spaced rearwardly apart from the front lip edge 16 are a series of connector openings 20 (only one of which is visible) extending downwardly through the lip 10 and aligned with its stabilizing projections 18.

Figure 2:
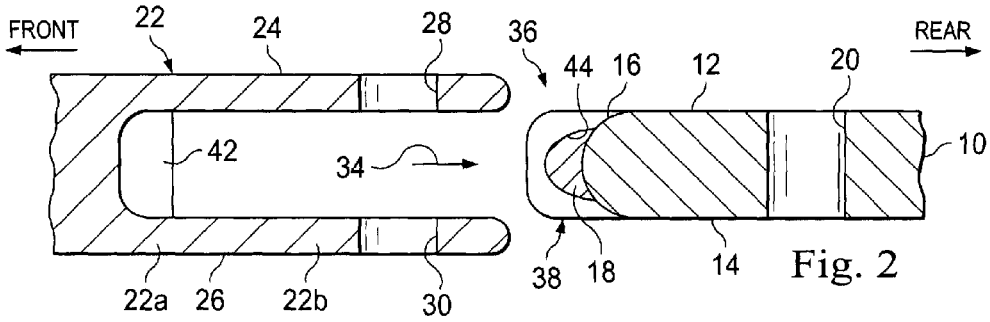
FIG. 2 is a schematic exploded partial cross-sectional view of the FIG. 1 structure taken generally along line 2-2.
Figure 3:
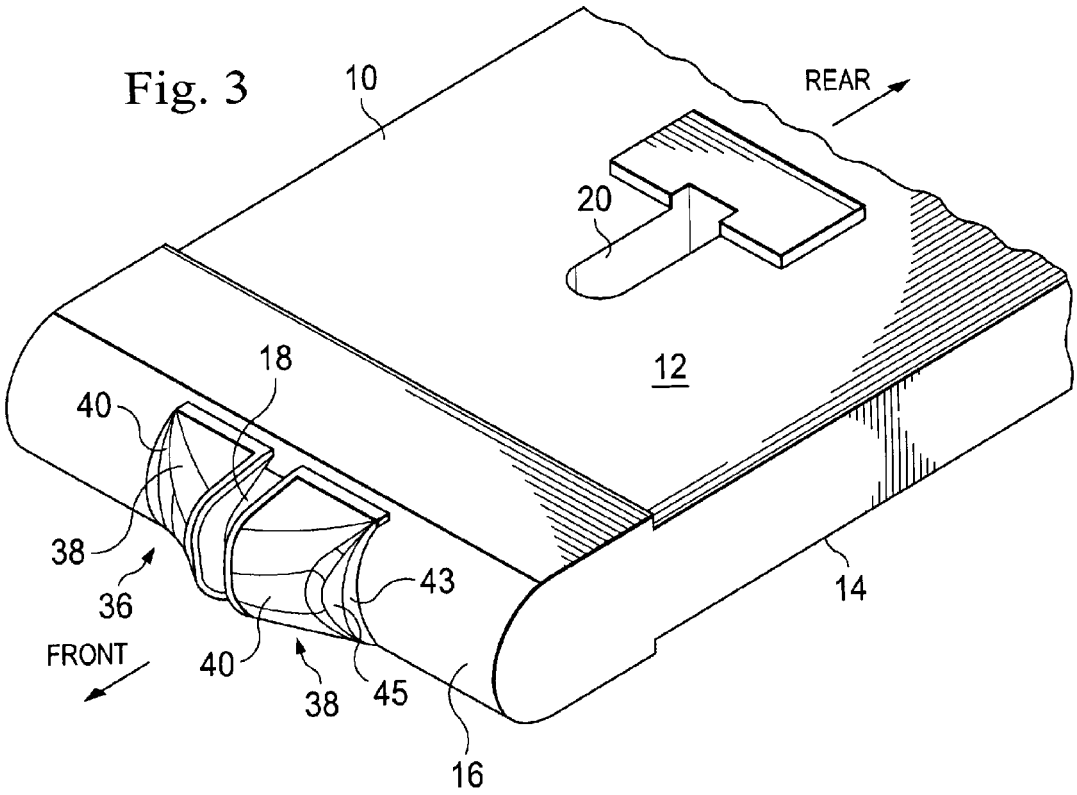
FIG. 3 is a perspective view of a front edge portion of the bucket lip with the adapter removed to reveal front stabilizing blocks removably secured to the bucket lip.

A wear member, representatively in the form of an adapter 22, is removably securable to the front lip edge 16 to form therewith an earth engaging assembly as shown in FIG. 1. Adapter 22 has a front portion 22*a* and a rear portion 22*b* extending rearwardly from the front portion 22*a* and having a pair of rearwardly projecting vertically spaced apart top and bottom legs 24,26 having aligned connector openings 28,30 (see FIG. 2) vertically extending therethrough. Another connector opening 32 (see FIG. 1) horizontally extends through the front or nose portion 22*a* of the adapter 22 for use in removably connecting another wear member, such as a replaceable tooth point (not shown), to the adapter 22. The adapter 22 is installed on the lip 10 by moving the adapter 22 rearwardly onto the lip 10, as indicated by the arrow 34 in FIG. 2, until a front edge portion of the lip 10 is straddled by the legs 24,26 and the leg openings 28,30 are aligned with the lip opening 20. A suitable connector structure (not shown) is then installed in the aligned openings 28,20,30 to removably retain the adapter 22 on the lip 10 as cross-sectionally illustrated in FIG. 1.

To inhibit undesirable side-to-side movement of the installed adapter 22 (i.e., parallel to the front lip edge 16) relative to lip 10, the present invention provides a specially designed stabilization structure 36 that includes two movable stabilizing block members 38 which are secured to the front lip edge 16 prior to the installation of the adapter 22 on the lip 10 in a further spaced apart position along the front lip edge 16 than that shown in FIG. 1. Representatively, the blocks 38 are magnetically secured to the metal lip 10 (for example, by using suitable schematically depicted magnet structures 39) prior to the installation of the adapter 22 on the lip 10 in a manner permitting the blocks 38 to be slidingly moved relative to the front lip edge 16 along the length thereof. Other suitable structures and techniques may be alternatively utilized to movably support the stabilizing blocks 38 on the front lip edge 16 prior to installation of the adapter 22 thereon.

The installed stabilizing blocks 38 have (1) sloping front surfaces 40 which are slidingly engageable by complementarily sloped interior surfaces 42 positioned within the adapter 22 adjacent the juncture of the adapter legs 24 and 26, (2) curved rear side surfaces 43, (3) relatively narrow outer ends 45 and wider inner ends 47, and (4) facing pocket areas 44 disposed at the junctions of the stabilizing block surfaces 43,47 and configured to permit entry into the pocket areas 44 of the illustrated lip stabilizing projection 18.

As the adapter 22 is rearwardly moved onto the lip 10 (as indicated by the arrow 34 in FIG. 2), sliding engagement between the sloped adapter surfaces 42 with the complementarily sloped block surfaces 40 causes the blocks 38 to move toward one another along the front lip edge 16, as indicated by the arrows 46 in FIG. 1, to cause the front lip projection 18 to be received in the facing block pockets 44. The previously mentioned connector structure (not shown) is then operatively placed in the aligned adapter and lip openings 28,20,30. The sloping configurations of the engaged adapter and block surfaces 42,40 substantially inhibits side-to-side horizontal movement of the installed adapter 22 relative to the front lip edge 16, and the installed block members 38 further shield the lip projection 18 from operational wear.

The foregoing detailed description is to be clearly understood as being given by way of illustration and example only, the spirit and scope of the present invention being limited solely by the appended claims.

What is claimed is:

1. Earth engaging apparatus comprising:

an elongated bucket lip having a front edge portion with a forwardly extending projection thereon;

a wear member operatively disposable on said lip by rearwardly moving said wear member onto said lip in a manner positioning a front portion of said wear member in a forwardly overlying relationship with said projection; and a stabilizing structure mountable on said front edge portion of said lip for movement along the length of said front edge portion toward said projection, said front portion of said wear member and said stabilizing structure being relatively configured in a manner such that during rearward positioning of said wear member on said lip said front portion of said wear member engages said stabilizing structure and moves said stabilizing structure toward said projection.

2. The earth engaging apparatus of claim 1 wherein:

said wear member is an adapter.

3. The earth engaging apparatus of claim 2 wherein:

said adapter has a rear portion including upper and lower legs configured to straddle said lip when said adapter is operatively installed thereon.

4. The earth engaging apparatus of claim 1 wherein:

said stabilizing structure comprises first and second stabilizing block members slidably mountable on said front edge portion of said lip on opposite sides of said projection.

5. The earth engaging apparatus of claim 4 wherein:

said front portion of said wear member is configured to engage said first and second stabilizing block members and slide each of them toward said projection in response to operative rearward positioning of said wear member on said lip.

6. The earth engaging apparatus of claim 5 wherein:

said first and second stabilizing block members have pocket areas therein which are configured to shieldingly receive portions of said projection in response to movement of said first and second stabilizing block members toward said projection by said wear member.

7. The earth engaging apparatus of claim 5 wherein:

said first and second stabilizing block members are configured to inhibit undesirable side-to-side movement of said wear member when said wear member is operatively mounted on said lip.

8. The earth engaging apparatus of claim 4 wherein:

each of said first and second stabilizing block members has an outer end, an inner end wider than said outer end, a rear side extending between said inner and outer ends, a front side extending between said inner and outer ends and being sloped relative to said rear side, and a pocket area positioned at the juncture of said rear side and said inner end and being configured to receive a portion of said projection in response to movement of the block member along said front edge of said lip toward said projection.

9. The earth engaging apparatus of claim 1 wherein:

said stabilizing structure includes a stabilizing member and a magnetic structure for slidingly attaching said stabilizing member to said front edge portion of said lip for movement along its length toward and away from said projection.

10. The earth engaging apparatus of claim 1 wherein:

said stabilizing structure includes first and second stabilizing members positionable on said front edge portion of said lip on opposite sides of said projection, and magnetic structures for slidingly holding said first and second stabilizing members on said front edge portion of said lip for movement toward and away from said projection.

11. The earth engaging apparatus of claim 1 wherein:

said stabilizing structure is mounted on said front edge portion of said lip for movement along the length of said front edge portion toward said projection, and said wear member is operatively disposed on said lip.

12. The earth engaging apparatus of claim 11 wherein:

said wear member is an adapter.

13. The earth engaging apparatus of claim 12 wherein:

said adapter has a rear portion including upper and lower legs straddling said lip.

14. The earth engaging apparatus of claim 11 wherein:

said stabilizing structure comprises first and second stabilizing block members slidably mounted on said front edge portion of said lip on opposite sides of said projection.

15. The earth engaging apparatus of claim 14 wherein:

said first and second stabilizing block members have pocket areas therein which are configured to shieldingly receive portions of said projection in response to movement of said first and second stabilizing block members toward said projection by said wear member.

16. The earth engaging apparatus of claim 15 wherein:

said first and second stabilizing block members have pocket areas therein which are configured to shieldingly receive portions of said projection in response to movement of said first and second stabilizing block members toward said projection by said wear member.

17. The earth engaging apparatus of claim 15 wherein:

said first and second stabilizing block members are configured to inhibit undesirable side-to-side movement of said wear member.

18. The earth engaging apparatus of claim 14 wherein:

each of said first and second stabilizing block members has an outer end, an inner end wider than said outer end, a rear side extending between said inner and outer ends, a front side extending between said inner and outer ends and being sloped relative to said rear side, and a pocket area positioned at the juncture of said rear side and said inner end and being configured to receive a portion of said projection in response to movement of the block member along said front edge of said lip toward said projection.

19. The earth engaging apparatus of claim 11 wherein:

said stabilizing structure includes a stabilizing member and a magnetic structure attaching said stabilizing member to said front edge portion of said lip for sliding movement along its length toward and away from said projection.

20. The earth engaging apparatus of claim 11 wherein:

said stabilizing structure includes first and second stabilizing members positioned on said front edge portion of said lip on opposite sides of said projection, and magnetic structures holding said first and second stabilizing members on said front edge portion of said lip for sliding movement therealong toward and away from said projection.

21. Earth engaging wear apparatus for use with a bucket lip having a front edge portion with a wear member stabilizing structure supported on the front edge portion of the bucket lip for sliding movement along its length, said earth engaging apparatus comprising:

an earth engaging wear member rearwardly movable onto the front edge portion of the bucket lip in a forwardly overlying relationship with the wear member stabilizing structure, said earth engaging wear member having a front portion with a concave rearwardly facing interior surface portion operative to engage and slidably move the stabilizing structure along the length of the front edge portion of the bucket lip in response to rearward movement of said earth engaging wear member relative to the bucket lip.

22. The earth engaging wear apparatus of claim 21 wherein:

said earth engaging wear member is an adapter.

23. The earth engaging wear apparatus of claim 21 wherein:

said earth engaging wear member has a rear portion including a spaced pair of mounting legs rearwardly projecting from said front portion of said earth engaging wear member and having front ends generally straddling said concave rearwardly facing interior surface of said front portion of said earth engaging wear member.

24. Earth engaging wear apparatus for use with a bucket lip having a front edge portion to which an earth engaging wear member having a front portion may be attached after a rear portion of the earth engaging wear member is rearwardly moved onto the front edge portion of the bucket lip, said earth engaging wear apparatus comprising:

a wear member stabilizing structure mountable on the front edge portion of the bucket lip and being receivable in the rear portion of the earth engaging wear member, the wear member stabilizing structure being slidingly movable along the length of the front edge portion of the bucket lip in response to engagement of the wear member stabilizing structure by the front portion of the earth engaging wear member during forcible rearward engagement of the front portion of the earth engaging wear member with said wear member stabilizing structure.

25. The earth engaging wear apparatus of claim 24 wherein:

the front edge portion of the bucket lip has a forwardly extending projection thereon, and said wear member stabilizing structure comprises first and second block members slidable toward and away from one another along said front edge portion of the bucket lip and having facing recesses formed therein for receiving portions of the forwardly extending projection on the front edge portion of the bucket lip.

* * * * *